US010099808B2

(12) United States Patent
Termanas et al.

(10) Patent No.: US 10,099,808 B2
(45) Date of Patent: Oct. 16, 2018

(54) APPARATUS AND METHOD FOR FORMING AND APPLYING EDGE PROTECTORS

(71) Applicant: Signode Industrial Group LLC, Glenview, IL (US)

(72) Inventors: Jeffrey D. Termanas, Rolling Meadows, IL (US); David C. Thomas, Lombard, IL (US); Janusz Ciurkot, Palatine, IL (US)

(73) Assignee: SIGNODE INDUSTRIAL GROUP LLC, Glenview, IL (US)

( * ) Notice: Subject to any disclaimer, the term of this patent is extended or adjusted under 35 U.S.C. 154(b) by 414 days.

(21) Appl. No.: 14/863,763

(22) Filed: Sep. 24, 2015

(65) Prior Publication Data

US 2016/0152363 A1 Jun. 2, 2016

Related U.S. Application Data

(60) Provisional application No. 62/085,974, filed on Dec. 1, 2014.

(51) Int. Cl.
*B65B 13/18* (2006.01)
*B65B 25/02* (2006.01)

(52) U.S. Cl.
CPC ..... *B65B 13/181* (2013.01); *B65B 25/026* (2013.01)

(58) Field of Classification Search
CPC ... B65B 13/181; B65B 25/026; B65D 85/505; B65D 85/52
USPC ..... 53/397
See application file for complete search history.

(56) References Cited

U.S. PATENT DOCUMENTS 4,048,839 A * 9/1977 Peterpaul ..... B21D 37/00 29/753
4,480,460 A * 11/1984 Bush ..... H01R 43/042 29/751
4,587,791 A * 5/1986 Brouse ..... B65B 13/181 53/139.6

(Continued)

FOREIGN PATENT DOCUMENTS

EP 2660158 A1 11/2013
EP 2700577 A1 2/2014

(Continued)

*Primary Examiner* — Sameh Tawfik
(74) *Attorney, Agent, or Firm* — Levenfeld Pearlstein, LLC

(57) ABSTRACT

A device forms and applies an edge protector to a corner of a load as strap is positioned and tensioned around the load, to position the edge protector between the strap and the load. The device includes a shuttle movable between a home position away from the load and an application position near the load. The shuttle includes a breaker assembly having a fixed portion and a movable portion. The movable portion is movable between a position in which it is generally planar with the fixed portion and another position in which it is transverse to the fixed portion. The breaker assembly includes a shoe that defines a receiving region between the shoe and the fixed and movable portions. The shuttle includes a load contact portion. Movement of the shuttle from the home position moves the movable portion from the first to the second position to fold the edge protector. Further movement of the shuttle and contact of the load contact portion with the load discharges the edge protector for receipt on the load as the strap is positioned and tensioned around the load.

20 Claims, 9 Drawing Sheets

(56) References Cited

U.S. PATENT DOCUMENTS

| | | | | | |
|---|---|---|---|---|---|
| 5,289,668 | A * | 3/1994 | Meyer | B65B 13/181 | 53/139.7 |
| 5,307,664 | A * | 5/1994 | Homm | B21D 39/04 | 29/237 |
| 5,311,996 | A * | 5/1994 | Duffy | B65D 71/04 | 206/453 |
| 5,551,212 | A * | 9/1996 | Odenthal | B65B 13/02 | 53/397 |
| 5,619,838 | A * | 4/1997 | Kasel | B65B 13/181 | 221/238 |
| 5,878,548 | A * | 3/1999 | Sauer | B60P 7/0869 | 206/453 |
| 6,540,080 | B2 * | 4/2003 | Moreyra | B65D 81/054 | 206/523 |
| 7,213,381 | B2 | 5/2007 | Zitella et al. | | |
| 7,383,952 | B2 * | 6/2008 | Kruelle | B65D 81/053 | 206/453 |
| 7,428,865 | B1 * | 9/2008 | Kasel | B65B 13/04 | 100/26 |
| 2011/0219845 | A1 * | 9/2011 | Schurder | B25B 7/20 | 72/409.01 |
| 2014/0311092 | A1 * | 10/2014 | Flores | B65B 13/181 | 53/410 |
| 2016/0114918 | A1 | 4/2016 | Kastner | | |

FOREIGN PATENT DOCUMENTS

| | | | |
|---|---|---|---|
| EP | 2700578 | A1 | 2/2014 |
| EP | 2700579 | A1 | 2/2014 |
| EP | 2733077 | A1 | 5/2014 |
| EP | 2778075 | B1 | 6/2015 |
| EP | 2778076 | B1 | 6/2015 |

* cited by examiner

APPARATUS AND METHOD FOR FORMING AND APPLYING EDGE PROTECTORS

CROSS-REFERENCE TO RELATED APPLICATION DATA

This application claims the benefit of and priority to Provisional U.S. Patent Application Ser. No. 62/085,974, filed Dec. 1, 2014, the disclosure of which is incorporated herein in its entirety.

BACKGROUND

Loads such as lumber and the like can be packaged as a plurality of stacked individual units formed into a 3-dimensional bundle. The bundles are secured by strap that is tensioned and sealed around the bundle. Bundles typically include corner protectors that extend along portions of the edges of the load, between the bundle and the straps that encircle the load and the corner protectors. Corner protectors are flat or planar members that are bent around and secured to the corner of the load. Known corner protectors include polymeric angled elements and fibrous, e.g., cardboard or paperboard elements.

Kasel, U.S. Pat. No. 5,619,838 discloses an apparatus and method for applying edge protectors that includes edge protector applicator assemblies positioned on a frame on either side of the load. The assemblies include grippers that receive and support flat, board-like edge protectors and laterally move to bring the protectors into proximity with the load. The strap, which is then positioned and tensioned around the load and protectors, folds the edge protectors around the load corners. Tensioning of the strap creates the movement that folds the protectors.

Kasel, U.S. Pat. No. 7,428,865 discloses a press-type strapping machine in which edge protectors are applied to the corners of loads that are pressed (compressed) and secured with a strap. Here too, corner protectors are brought into contact with the load by grippers and the corner protectors are formed or bent by the strap as it is pulled onto and tensioned around the load.

While such devices function well, the corner protectors may not properly fold along the edge of the load. As such, the protectors may not seat properly on the load and may be subject to being torn or struck and dislodged from the load.

Preformed edge protectors are also known. However, the preformed protectors require additional steps in the manufacture of the corner protectors. Moreover, excess space is required to store the preformed protectors both in storage and on a strapping machine, and automated systems to position such protectors on a load are limited.

Accordingly, there is a need for an apparatus and method to fold and apply corner edge protectors on a load during a strapping operation. Desirably, such an applicator receives a planar edge protector and folds the edge protector to conform to the corner of the load, prior to positioning the protector on the load. More desirably still, the applicator discharges the folded edge protector onto the load as the strap is positioned around the load so that it is pulled by and captured between the strap and load and is secured to the load by the tensioned strap. Still more desirably, the edge protectors can be stored on the strapping machine in a flat state to reduce storage requirements.

SUMMARY

A device for forming and applying an edge protector to a corner of a load works in conjunction with a strapping machine that positions and tensions strap around the load. The device receives an edge protector as a flat element, folds the edge protector to conform to the corner of the load and discharges the folded edge protector onto the load as the strap is positioned around the load. In this manner, the edge protector is pulled by the strap and is captured between the strap and load, and is secured to the load by the strap as it is tensioned and sealed to itself.

The device includes a shuttle operably movable between a home position distal from the load and an application position proximal the load. The shuttle includes a breaker assembly having a fixed portion and a movable portion. The movable portion is movable between a first position in which it is generally planar with the fixed portion and a second position in which it is generally transverse to the fixed portion. In an embodiment, the movable portion is pivotally mounted to the fixed portion. The breaker assembly includes a shoe and defines a receiving region between the shoe and the fixed and movable portions. The shuttle includes a load contact portion.

As the shuttle moves off of the home position, the movable portion pivots from the first position to the second position to fold the edge protector to about a 90 degree angle. Further movement of the shuttle and contact of the load contact portion with the load discharges the folded edge protector for receipt on the load. The edge protector is received on the load, between the load and the strap, as the strap is pulled onto the load so that when the strap is tensioned, it secures the folded edge protector on the load.

In an embodiment, the device includes a support that defines a track. The shuttle is operably mounted to the support and the movable portion includes a track engaging member, such as a roller, that cooperates with the track for pivoting the movable portion from the first position to the second position as the shuttle moves from the home position to the application position.

The shuttle includes a pusher element, such as a pusher finger, operably connected to the load contact portion to push the edge protector from the receiving region in a direction transverse to a direction of movement of the shuttle along the track when the load contact portion contacts the load. In an embodiment, one or more retention elements hold the edge protector in the receiving region. The retention elements can be, for example, a spring loaded finger, a ramped projection or both.

The device can include an edge protector magazine for storing a plurality of edge protectors, for example, a stack of edge protectors, separating individual edge protectors from the stack and feeding individual edge protectors to the breaker assembly. In an embodiment, the edge protectors are separated from the stack as they are fed to the breaker assembly. A reciprocating element can be used to push individual edge protectors from the stack to feed the edge protectors to the breaker assembly. In an embodiment, an edge protector magazine can be associated with each breaker assembly.

A method for forming and applying an edge protector to a corner of a load as strap is pulled onto and tensioned around the load to capture and secure the edge protector between the strap and the load, includes receiving an edge protector in a flat state in a breaker assembly and holding the edge protector in the breaker assembly. The edge protector is conveyed toward the load in a conveying direction, and is folded about 90 degrees to substantially conform to a corner of the load. The edge protector is pushed from the breaker assembly in a direction transverse to the conveying direction as strap is pulled onto and tensioned around the load. In this manner the edge protector is captured between the strap and the load, and is secured to the load by the tensioned strap.

In a method, folding the edge protector can be carried out during the step of conveying the edge protector toward the load. The method can include carrying the breaker assembly on a shuttle and conveying the shuttle toward the load. The method further includes positioning and tensioning a strap around the load such that the edge protector is captured between the strap and the load and is held against the load by the tensioned strap. Because the edge protector is pushed out of the breaker assembly, when the strap is pulled around the load, it contacts the edge protector and pulls the edge protector onto the load.

In that the edge protector is formed or bent before it is secured to the load (before the strap pulls the edge protector onto the load), the opportunity for misfeeding the edge protector, for the edge protector to not fold in the proper location or for the edge protector to not sit properly on the corner of the load is greatly reduced if not eliminated.

It will be apparent that edge protectors can be positioned on any or all of the corners of the load at the same time or essentially the same time, as the strap is positioned, tensioned and secured around the load. During the step of encircling the load with the strap, the folded edge protector can be drawn from the breaker assembly into contact with the load.

In an embodiment, the edge protector can be temporarily held in the breaker assembly during the steps of conveying and folding the edge protector. The method can further include storing at least two edge protectors, separating one of the edge protectors from the other and feeding the separated edge protector to the breaker assembly.

These and other features and advantages of the present invention will be apparent from the following detailed description, in conjunction with the appended claims.

DETAILED DESCRIPTION

While the present device and method are susceptible of embodiment in various forms, there is shown in the figures and will hereinafter be described an embodiment of the device with the understanding that the present disclosure is to be considered an exemplification of the device and method and is not intended to be limited to the specific embodiment illustrated and method described.

Figure 1:
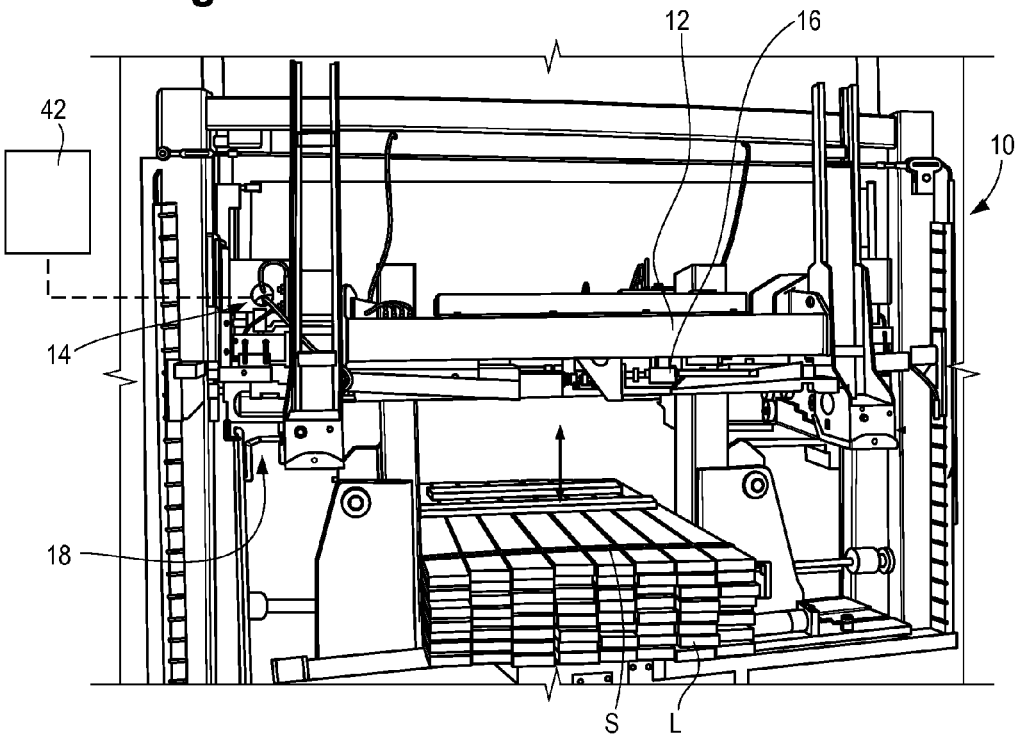
FIG. 1 is a front view of a strapping machine, specifically a lumber press, on which the present apparatus for forming and applying edge protectors can be used.
Figure 1A:
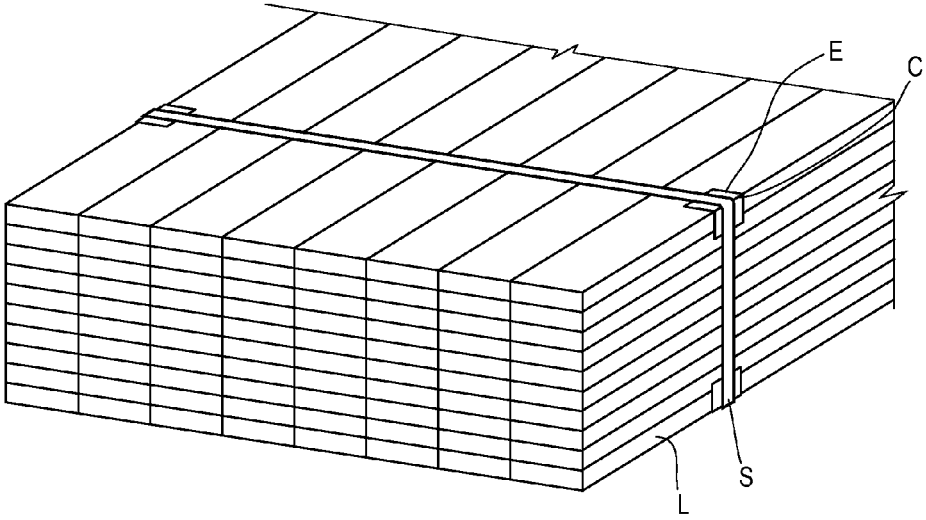
FIG. 1A is a perspective illustration of a load of lumber with a pair of edge protectors on an top/side corners of the load and a band of strap positioned around the lumber and the edge protectors.

Referring to the figures and in particular to FIG. 1, there is shown an example of a strapping machine 10, and as illustrated, a lumber press and strapper. The strapping machine 10 is configured to compress a load L, such as lumber and to position, tension and seal strap S to itself around the load L, with edge protectors E positioned between the strap S and the load L, as illustrated in FIG. 1A.

The machine 10 includes a press 12 to compress the load L, and a strapping system 14, such as that disclosed in Kasel, U.S. Pat. No. 7,428,865, which patent is commonly assigned with the present application and is incorporated herein by reference. The strapping system 14 includes a sealing head 16 that seals the overlapping courses of strapping material S to itself. Those skilled in the art will recognize and appreciate the lumber strapper 10 as well as other strapping devices with which the present edge protector applicator 18 can be used.

The strapping system 14 positions strap S around the load L, tensions the strap S and seals the strap S to itself. Edge protectors E are positioned at the corners C, between the strap S and the load L to protect the load L from damage by the strap S. It will be understood that although the figures show edge protectors E on the top/side corners C of the load L, edge protectors E can be applied to the bottom/side corners of the load L as well.

The edge protector applicators 18 work in conjunction with the strapping system 14. The applicators 18 receive an edge protector as a flat element, fold the edge protector to conform to the corner C of the load L and discharge the folded edge protector E onto the load as the strap S is positioned around the load L. In this manner, the edge protector E is pulled by the strap S as the strap S is pulled onto the load L, and is captured between the strap S and load L and is secured to the load L by the tensioned and sealed strap S.

Figure 2:
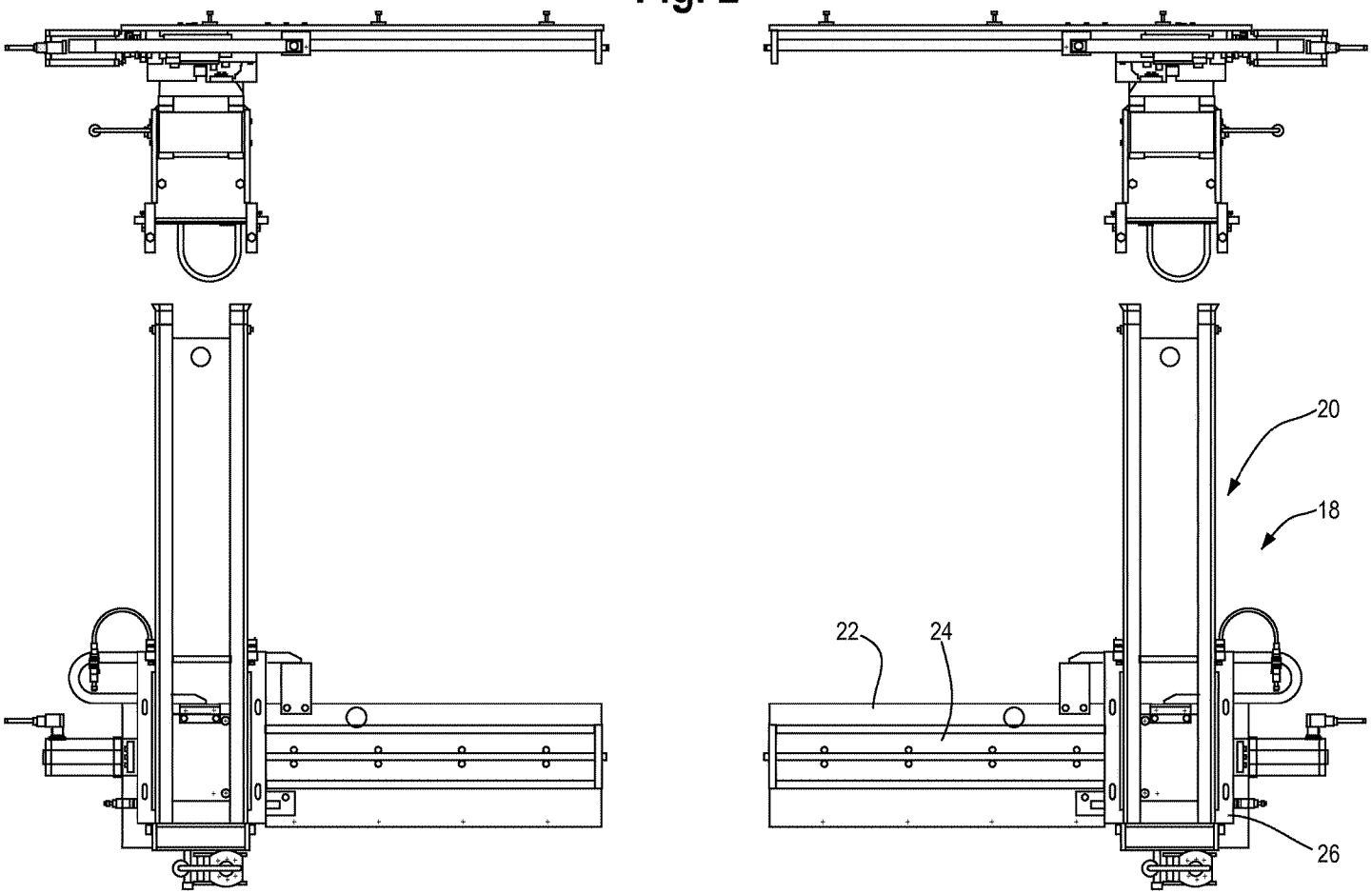
FIG. 2 is a partial front view of the apparatus separate from the lumber press.
Figure 3:
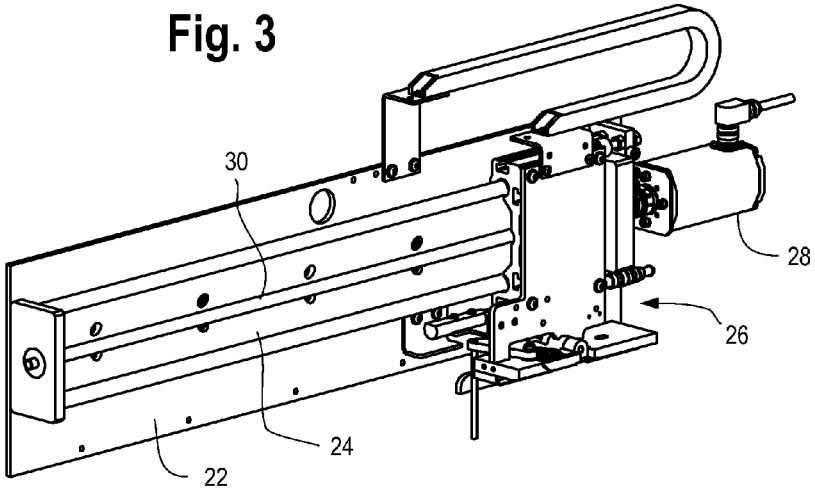
FIG. 3 is a front perspective view of an embodiment of an edge protector applicator assembly, the illustrated assembly being the right-hand side assembly of FIG. 2.
Figure 4:
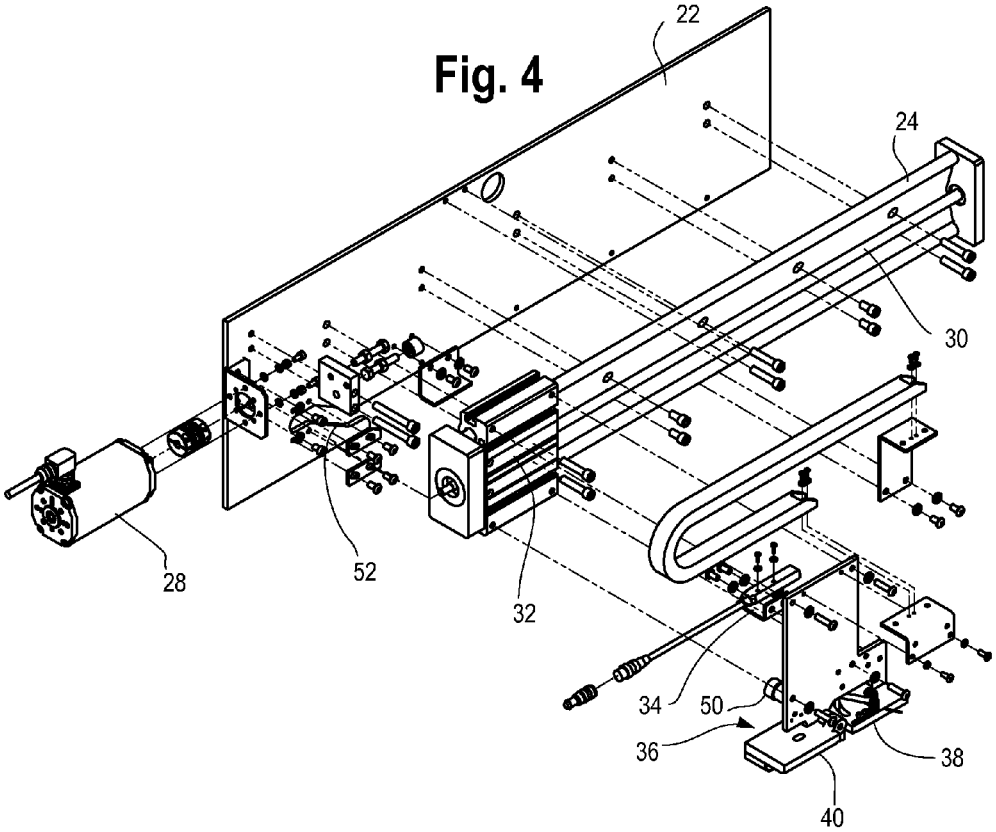
FIG. 4 is an exploded view of the assembly, the illustrated assembly being the left-hand side assembly of FIG. 2
Figure 5:
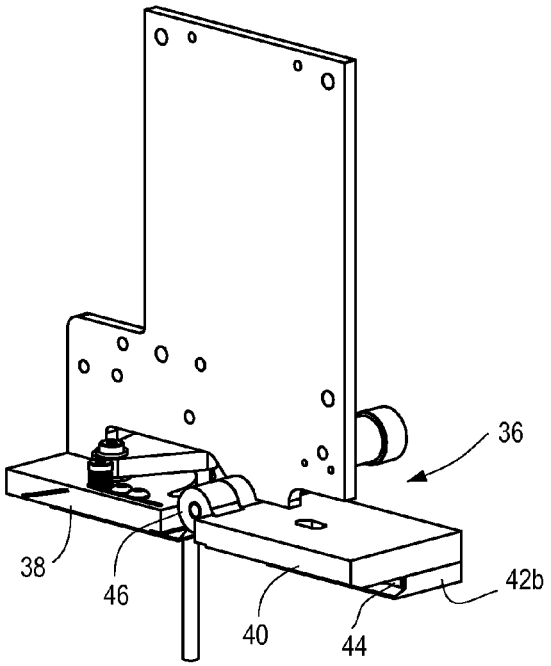
FIG. 5 is a perspective view of an angle breaker assembly, the illustrated assembly being the left-hand side assembly of FIG. 2.
Figure 6:
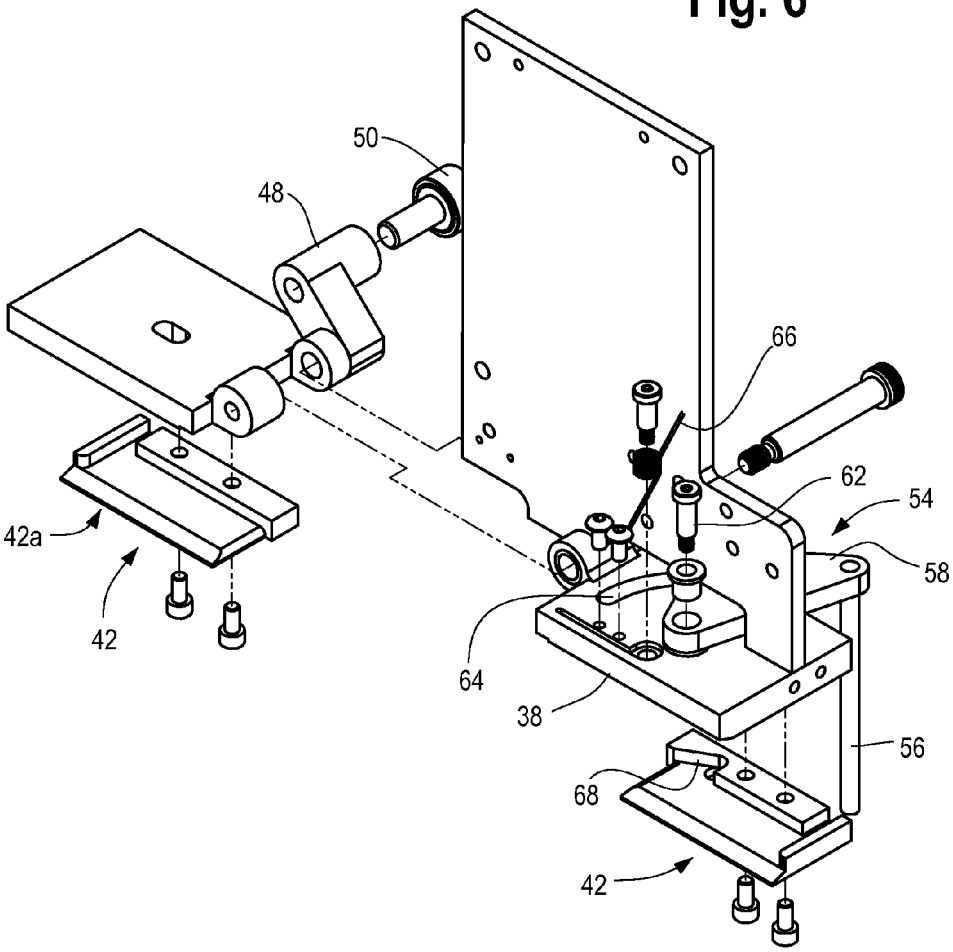
FIG. 6 is an exploded view of an angle breaker assembly, the illustrated assembly being the right-hand side assembly of FIG. 2.

FIG. 2 illustrates left and right-hand side edge protector applicators 18 and the associated edge protector magazines 20 to store a plurality of edge protectors E and feed individual edge protectors E to their respective applicators 18. Each applicator 18 includes a support plate 22, a linear rail 24, a shuttle 26 and a drive 28. Each shuttle 26 moves along its rail 24, driven by its drive 28, between a position at which an edge protector E is fed to the applicator 18 (an outboard position) and a position at which the edge protector E is brought into contact with the load L and ejected from the applicator 18 (an inboard position). Reference may be made to a single shuttle, however, it will be understood that there are both left- and right-hand shuttles. It will also be appreciated that although the figures show edge protector applicators 18 applying edge protectors E to the top/side corners C of the load L, the applicators can be used to apply edge protectors to the bottom/side corners of the load L as well.

Referring to FIGS. 3-6, in an embodiment, the shuttles 26 move along their rails 24 between the inboard and outboard positions by actuation of the drives 28 which drive threaded or screw drive shafts 30. The shuttles 26 include a threaded receiver 32 that cooperates with their respective shafts 30 to move the shuttles 26 back and forth along the rails 24. Sensors 34 mounted to the applicators 18 monitor the positions of the shuttles 26. In an embodiment, the sensors 34 are mounted to the shuttles 26. It will, however, be appreciated that various types of drives can be used to move the shuttles 26 and that the sensors 34 can be mounted in a variety of locations and manners to monitor the positions of the shuttles 26.

Figure 8:
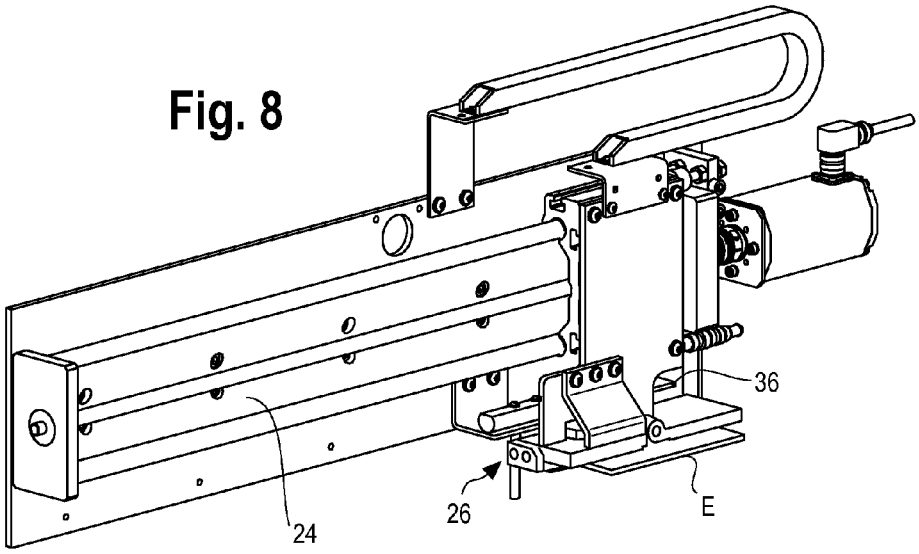
FIG. 8 is a perspective similar to FIG. 3 showing an edge protector in place in the breaker assembly.
Figure 9A:
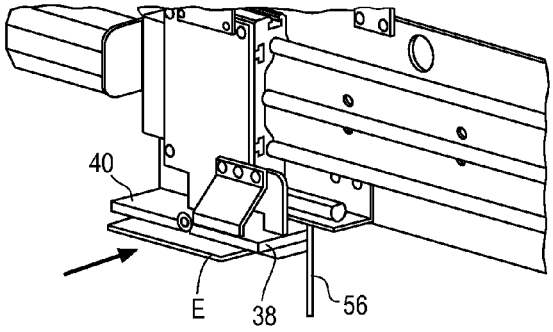
FIGS. 9A and 9B are front and rear perspective views of the right-hand side assembly showing the edge protector in place in the breaker assembly prior to folding.
Figure 10A:
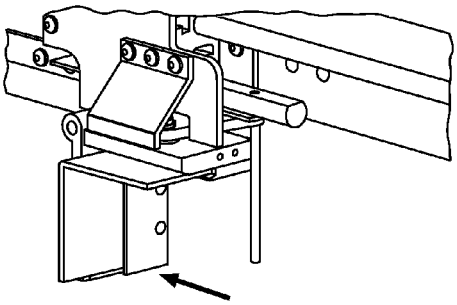
FIGS. 10A and 10B are front and rear perspective views of the assembly with the edge protector in place and with the edge protector folded.
Figure 10B:
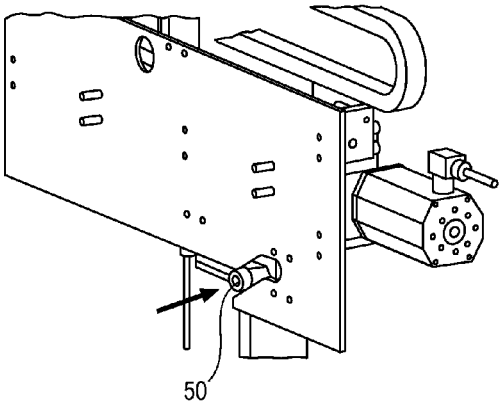
Figure 11A:
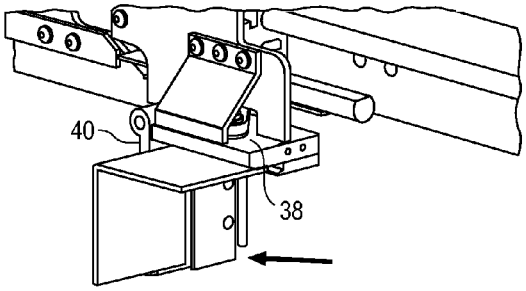
FIGS. 11A and 11B are front and rear perspective views of the assembly with the edge protector in place and folded, and showing the position of the edge protector when pressed to the load and as the edge protector is ejected from the assembly.
Figure 11B:
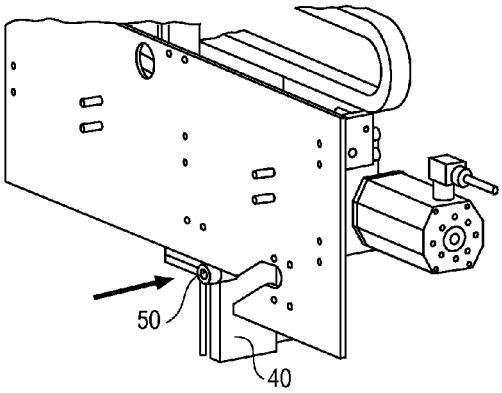
Figure 12:
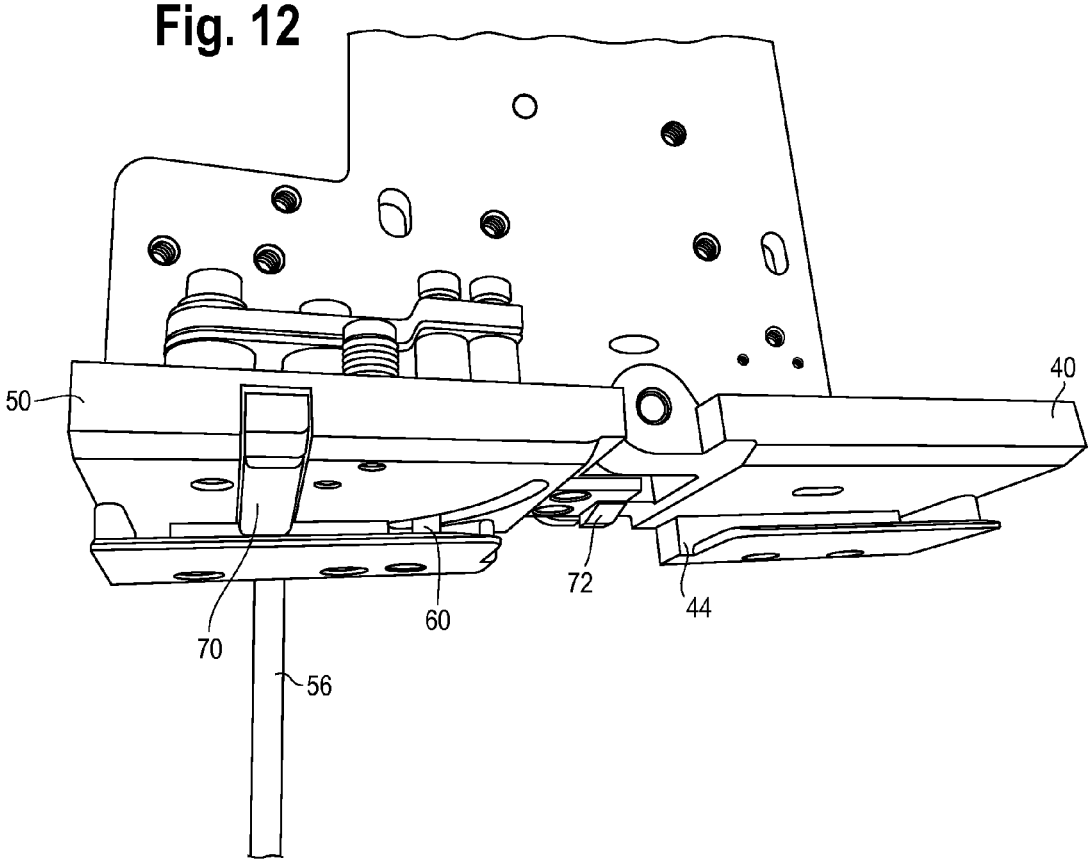
FIG. 12 is a photograph of a side view of the breaker assembly, showing the spring loaded finger and the ramp projection.
Figure 13:
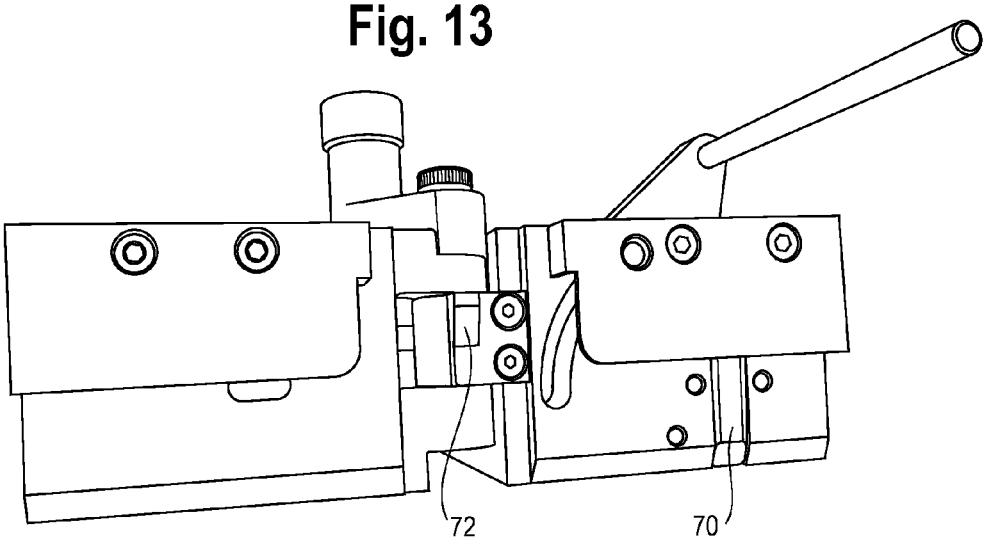
FIG. 13 is a photograph of a bottom view of the breaker assembly.
Figure 14:
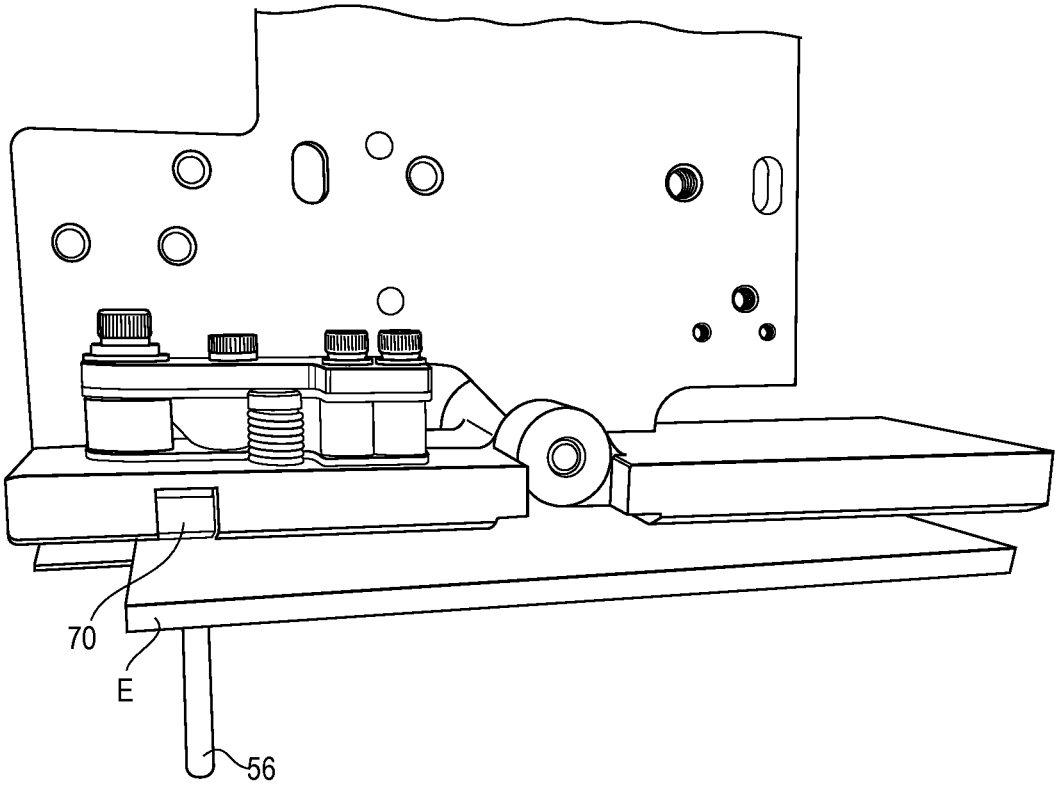
FIG. 14 is a side view similar to FIG. 12, showing the breaker assembly with an edge protector in the receiving region.

The shuttles 26 include a breaker assembly 36 that is configured to receive an edge protector E in a flat state (see, e.g., FIGS. 8 and 9A) and fold, bend or break the protector E into a corner that is at or about a 90 degrees (see, e.g., FIGS. 1A, 10A and 11A) to conform to the corners C of the load L. It will be understood that the material from which the edge protector is formed, e.g., paperboard or cardboard, will bend or fold and will be deformed, but that it may return, to some minor extent, to its pre-folded shape. As such, the final configuration, prior to being applied to the load and secured by the strap is described as at or about 90 degrees.

In an embodiment, the breaker assembly 36 includes a fixed member 38, a movable member 40 and a shoe 42*a*, 42*b* (collectively 42) associated with each the fixed 38 and movable 40 member. In an embodiment, the fixed and movable members 38, 40 are plates and oppose the shoes 42 to define a receiving region 44 for receiving the flat edge protectors E. The receiving region 44 is formed as a recess or channel in which the flat edge protector E is inserted and held. The movable plate 40 is pivotally mounted to the fixed plate 38 by a hinge or pivot 46. The movable plate is pivotable between about 0 degrees and 90 degrees relative to the fixed plate 38 so that a flat edge protector E is received in the receiving region 44 when the movable plate 40 is in the 0 degree position, and when the movable plate 40 pivots it folds or breaks the edge protector E to about 90 degrees.

Figure 9B:
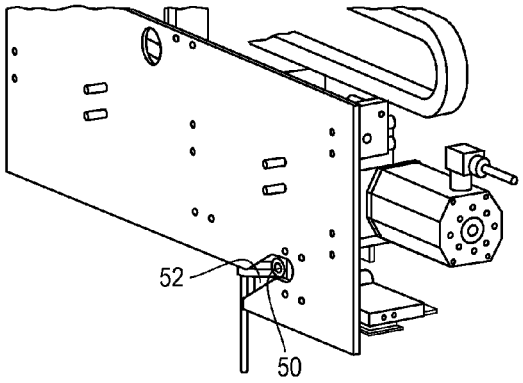

The movable plate 40 includes an arm 48 and a roller 50 extending outwardly and downwardly from a rear thereof that engages a track 52 in the support plate 22. The track 52 has an angled or sloping edge 54 along which the roller 50 rides. When the shuttle 26 is in the outboard or home position (see, FIGS. 9A and 9B), the roller 50 is elevated so that the movable plate 40 is in the 0 degree position. As the shuttle 26 moves off the home position (toward the load or toward the inbound position, see FIGS. 10A and 10B, and 11A and 11B), the roller 50 is urged downward which pivots the movable plate 40 to fold or break the edge protector E.

The breaker assembly 36 includes a pusher assembly 54 to push the edge protector E from the assembly 36 when the folded edge protector E approaches or contacts the load L. The pusher assembly 54 includes a contact arm 56, a pivot plate 58 and a pusher element 60, such as the illustrated pusher finger. The pivot plate 58 is mounted to the fixed plate 38 by a pivot pin 62 at an end of the plate 38. The contact arm 56 is mounted to an end of the pivot plate 58 opposite the pivot 62. The contact arm 56 extends downwardly so as to contact the load L as the shuttle 26 approaches the load L. The pusher finger 60 is formed on or extends from the pivot plate 58, through a slotted opening 64 in the pivot plate 58 and is positioned in the breaker assembly receiving region 44, extending downwardly toward the shoe 42. As the shuttle 26 moves to the load L, the contact arm 56 contacts the load L, which pivots the pivot plate 58 and moves the pusher finger 60 into the receiving region 44 to push the edge protector E from the receiving region 44. A spring 66 on the breaker assembly 36 returns the pusher finger 60 to the home position. A slot 68 in the shoe 42 accommodates the pusher finger 60 when in the home position to prevent the finger 60 from interfering with the breaker assembly 36 receiving and securing the edge protector E in the receiving region 44.

In an embodiment, the breaker assembly 36 can include one or more retention elements to positively secure the edge protector E in the receiving region 44. In an embodiment, a spring loaded finger 70 in the fixed plate 38 applies pressure on the edge protector E and holds it against the shoe 42 as the shuttle 26 moves and as the edge protector E is folded. The finger 70 is spring loaded, so that the edge protector E remains in place, but is forced out of the receiving region 44 when the pusher finger 60 exerts sufficient force on the edge protector E to dislodge it from the between the finger 70 and the shoe 42. The breaker assembly 36 can also include a ramped projection 72 extending into the receiving region 44. Either or both the spring loaded finger 70 and the ramp 72 can be used to hold the edge protector E in the receiving region as the edge protector E is received in the breaker assembly 36, folded, and conveyed toward the load L.

Figure 7:
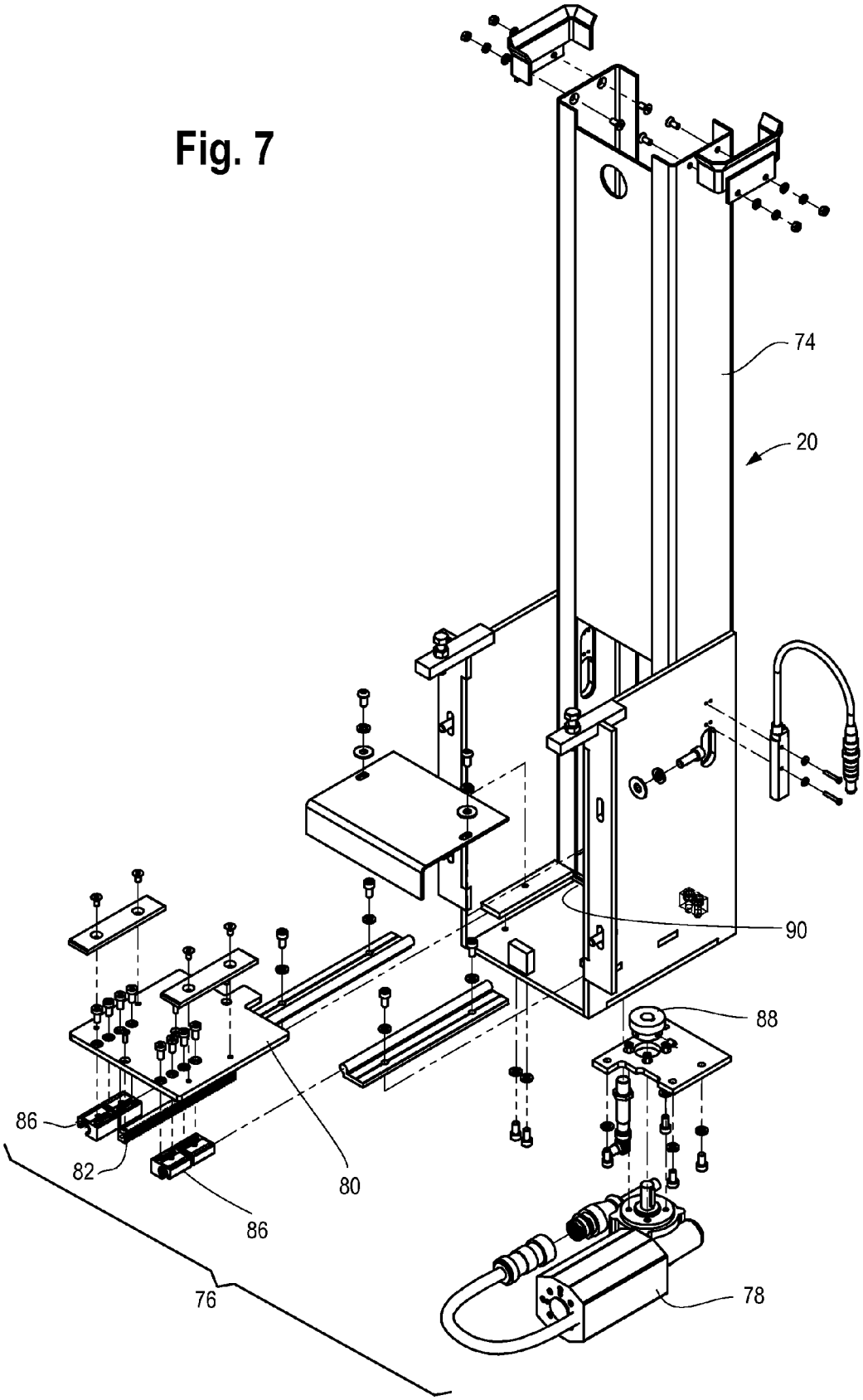
FIG. 7 is an exploded view of an example of an edge protector magazine.

Referring now to FIGS. 2 and 7 there is shown an embodiment of the magazine assembly 20 for storing a plurality of edge protectors E, such as in a stack K, separating individual edge protectors E from the stack and feeding the separated edge protector E to the breaker assembly 36. The magazine assembly 20 includes, generally, a storage magazine 74, a reciprocating feeder 76 and a drive 78. The storage magazine 74 is configured to store a plurality of flat edge protectors E in, for example, a stack K and to supply edge protectors E to the feeder 76. The feeder 76 includes a reciprocating plate 80 having a thickness about the same as or slightly less than that of the edge protectors E. A rack gear 82 is mounted to a side of the plate 80 opposite the side that contacts the edge protectors E. Rails 84 mounted to the magazine assembly 20 cooperate with linear bearings 86 mounted to the plate 80 to facilitate the reciprocating movement of the plate 80.

In an embodiment, the drive 78 is mounted to the assembly 20 and a drive gear 88 is mounted to the drive 78. The drive gear 88 is operably connected to the rack gear 82 to provide the reciprocating movement of the plate 80.

An opening 90 at the discharge of the magazine 74 is sized to permit only a single edge protector E from being discharged from the magazine 74 at a time. Separation of individual edge protectors E from the stack K is accomplished by cooperation of the feeder plate 80 (which has a thickness about the same as or slightly less than that of the edge protectors E), along with the opening 90 at the bottom of the magazine 74 (which is slightly larger than the thickness of one edge protector E). As such, as the plate 80 reciprocates, it contacts an edge protector E along an edge of the plate 80. The edge protector E is pushed from the stack K, out through the opening 90 at the discharge of the magazine 74. As the edge protector E is pushed, it is fed into the receiving region 44 in the breaker assembly 36, between the fixed/movable members 38/40 and the shoe 42, and is captured and held in the receiving region 44 by the spring loaded finger 70, the ramp 72 or like holding device. It will be appreciated that while the figures show a magazine assembly 20 and structure to feed edge protectors E from a bottom of the magazine 74 to the breaker assembly 36 (and the bottom of the load L), the magazine assembly 20 and breaker assembly 36 can be configured to supply edge protectors E to an overhead assembly to supply edge protectors E to a location at the top of the load L.

In operation, a load L is present in the strapping machine 10 and the shuttles 26 are in the home or outboard positions, distal from the load. The magazine assembly drives 78 are actuated and the feeder plates 80 reciprocate to feed edge protectors E into the receiving regions 44 of the breaker assemblies 36. The edge protectors E are held in place in the breaker assemblies 36 (in the receiving regions 44) by the spring loaded fingers 70, ramps 72 or like holding device.

The breaker assemblies 38 move out of the home position, along their linear rails 24, toward the load L. As the breaker assemblies 36 begin to move, the rollers 50 contact the support plate tracks 52 and pivot the movable plates 40 to fold or "break" the edge protectors E. The shuttles 26 continue to move toward the load L. As the shuttles 26 approach the load L, the contact arms 56 contact the load L which pivot the pivot plates 58 and move the pusher fingers 60 into contact with the edge protectors E, which in turn pushes the edge protectors E out of the breaker assemblies' receiving regions 44 in a direction transverse to the movement of the shuttle 26. In this proximal or application position, the folded edge protectors E are freed from their breaker assemblies 36 so that they can be secured to the load L when the strap is positioned and tensioned around the load L and edge protectors E. Following release of the edge protectors E, the shuttles return to their home or outboard positions.

Contact of the contact arms 56 with the load L is timed with the strapping machine 10 such that the edge protectors E are pushed from the breaker assemblies 36 as the strap S is drawn around the load L and retracted (to pull the strap S from the strap chute) and as the strap S is tensioned around the load L. The overall timing of the strapping machine 10 and application of the edge protectors E can be carried out using a controller or control system 92 that monitors and controls the function of the machine 10. In this manner, the edge protectors E are captured by the strap S against the load L and are held in place by the strap S as and in conjunction with tensioning and sealing of the strap S.

It will be appreciated by those skilled in the art that the relative directional terms such as upper, lower, rearward, forward and the like are for explanatory purposes only and are not intended to limit the scope of the disclosure.

All patents referred to in the present disclosure, are incorporated herein by reference in their entirety, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A device for forming an edge protector and applying the edge protector to a corner of a load, the device, comprising:

a shuttle movable between a home position distal from the load and an application position proximal to the load, the shuttle including:

a breaker assembly having a fixed member and a movable member that is movable relative to the fixed member between a first position in which the movable member is coplanar with the fixed member and a second position in which the movable member is transverse to the fixed member, the breaker assembly also including a shoe, and a receiving region between the shoe and the fixed and movable members; and a load contact member, wherein movement of the shuttle from the home position toward the application position causes the movable member to move from the first position to the second position to fold the edge protector, and wherein further movement of the shuttle and contact of the load contact member with the load causes the folded edge protector to be discharged onto the corner of the load.

2. The device of claim 1, further including a support defining a track, the shuttle being movably mounted to the support, wherein the movable member includes a track engaging member cooperating with the track to cause the movable member to move from the first position to the second position as the shuttle moves from the home position to the application position.

3. The device of claim 2, further comprising:

a rail mounted to the support and to which the shuttle is mounted; and a drive to move the shuttle along the rail and relative to the support between the home position and the application position.

4. The device of claim 3, wherein the shuttle includes a threaded receiver, the device further comprising a threaded drive shaft threadably received in the threaded receiver, wherein the drive is operably connected to the threaded drive shaft to rotate the threaded drive shaft to cause the shuttle to move along the rail between the home position and the application position.

5. The device of claim 1, wherein the movable member is pivotably mounted to the fixed member to enable the movable member to pivot between the first and second positions.

6. The device of claim 1, the shuttle further including a pusher element connected to the load contact member to push the edge protector from the receiving region in a direction transverse to a direction of movement of the shuttle between the home position and the application position when the load contact member contacts the load.

7. The device of claim 6, wherein the pusher element is a pusher finger.

8. The device of claim 6, wherein the shuttle includes a pivot member to which the load contact member and the pusher element are connected, wherein the pivot member is pivotably connected to the fixed member and movable between a retain position and a discharge position.

9. The device of claim 8, wherein the fixed member defines a curved slot therethrough and the pusher element extends through the curved slot.

10. The device of claim 9, wherein movement of the pivot member from the retain position to the eject position when the edge protector is received in the receiving region causes the pusher element to contact and discharge the edge protector from the receiving region.

11. The device of claim 1, the shuttle further including a retention element to hold the edge protector in the receiving region.

12. The device of claim 11, wherein the retention element is a spring loaded finger, a ramped projection or both.

13. The device of claim 1, further including an edge protector magazine to store a plurality of edge protectors and to sequentially feed the edge protectors to the breaker assembly.

14. The device of claim 13, wherein the edge protector magazine includes a reciprocating element to separate individual edge protectors from the plurality of edge protectors and to sequentially feed the individual edge protectors to the breaker assembly.

15. The device of claim 14, wherein the edge protector magazine further includes a drive to move the reciprocating element in a reciprocating fashion.

16. The device of claim 14, wherein reciprocating element comprises a rack gear, and wherein the drive is operably connected to a drive gear that drivingly engages the rack gear.

17. The device of claim 13, further including multiple breaker assemblies and multiple edge protector magazines to sequentially feed edge protectors to a different one of the breaker assemblies.

18. The device of claim 1, further comprising:

a drive operably connected to the shuttle to move the shuttle; and a controller configured to control the drive to move the shuttle between the home position and the application position.

19. The device of claim 18, further comprising a strapping system to position a strap around the edge protector and the load, tension the strap, and seal the strap to itself.

20. The device of claim 19, wherein the controller controls the strapping system to tension the strap around the edge protector and the load after controlling the shuttle to discharge the edge protector onto the load.

* * * * *